United States Patent [19]

Iwamoto et al.

[11] 4,439,252

[45] Mar. 27, 1984

[54] METHOD OF PRODUCING GRAIN-ORIENTED SILICON STEEL SHEETS HAVING EXCELLENT MAGNETIC PROPERTIES

[75] Inventors: Katsuo Iwamoto, Kakogawa; Tomomichi Goto, Kobe; Yoshinori Kobayashi, Takarazuka; Yoshiaki Iida; Isao Matoba, both of Kobe, all of Japan

[73] Assignee: Kawasaki Steel Corporation, Kobe, Japan

[21] Appl. No.: 421,809

[22] Filed: Sep. 23, 1982

[30] Foreign Application Priority Data

Sep. 26, 1981 [JP] Japan ..... 56-152466

[51] Int. Cl.³ ..... H01F 1/04

[52] U.S. Cl. ..... 148/111; 148/110; 148/113

[58] Field of Search ..... 148/110, 111, 112, 113

[56] References Cited

U.S. PATENT DOCUMENTS

| | | | |
|---|---|---|---|
| 3,908,432 | 9/1975 | Ichiyama et al. | 148/111 |
| 3,932,234 | 1/1976 | Imanaka et al. | 148/111 |
| 3,933,537 | 1/1976 | Imanaka et al. | 148/111 |
| 4,115,161 | 9/1978 | Datta | 148/111 |
| 4,123,298 | 10/1978 | Kohler et al. | 148/111 |

*Primary Examiner*—John P. Sheehan

*Attorney, Agent, or Firm*—Balogh, Osann, Kramer, Dvorak, Genova & Traub

[57] ABSTRACT

A grain-oriented silicon steel sheet having excellent magnetic properties can be stably produced by adjusting properly the C content in a silicon steel to be used as a starting material depending upon the Si content in the steel, removing a proper amount of C from the steel during the course after the hot rolling and before the final cold rolling, and further carrying out the final cold rolling at a reduction rate of 40–80%.

8 Claims, 14 Drawing Figures

| | Mark | Range of [Si%] | | |
|---|---|---|---|---|
| | | 2.8~3.1% | 3.3~3.5% | 3.6~3.8% |
| $W_{17/50}$ (w/kg) | ◎ | ≦1.05 | ≦1.00 | ≦0.95 |
| | ○ | ≦1.10 | ≦1.05 | ≦1.00 |
| | ● | ≦1.15 | ≦1.10 | ≦1.05 |
| | × | >1.15 | >1.10 | >1.05 |

← Rolling Direction

← Rolling Direction

METHOD OF PRODUCING GRAIN-ORIENTED SILICON STEEL SHEETS HAVING EXCELLENT MAGNETIC PROPERTIES

BACKGROUND OF THE INVENTION

1. Field of the Invention

The present invention relates to a method of producing grain-oriented silicon steel sheets having excellent magnetic properties.

2. Description of the Prior Art

Grain-oriented silicon steel sheets are mainly used in an iron core of a transformer and other electric instruments, and are demanded to have excellent magnetic properties, that is, have an excellent magnetizing property and a low iron loss. Recently, technics for producing silicon steel sheet have been progressed; and a grain-oriented silicon steel sheet having an excellent magnetizing property, that is, having a high magnetic induction of $B_{10}$ value of more than 1.89 T (teslas) has been obtained and contributes to the production of small size transformer and other electric instruments and to the decreasing of noise; and further a grain-oriented silicon steel sheet having a low iron loss of $W_{17/50} \leqq 1.10$ W/kg in a sheet thickness of 0.30 mm, that is, having an iron loss of not more than 1.10 W per kg of the steel sheet when the steel sheet having a sheet thickness of 0.30 mm is magnetized under a magnetic induction of 1.7 T and at a frequency of 50 Hz, has been obtained.

A fundamental requirement for obtaining a grain-oriented silicon steel sheet having such excellent magnetic properties is that secondary recrystallized grains having (110)[001] orientation are fully developed during the final annealing. It is commonly known that the following conditions are required for this purpose, that is, the presence of inhibitor which suppresses strongly the growth of primary recrystallized grains having an undesirable orientation other than the (110)[001] orientation during the secondary recrystallization, and the formation of recrystallization texture which is effective for the predominant and sufficient development of secondary recrystallized grains having a strong (110)[001] orientation. As the inhibitors, there are generally used fine precipitates of MnS, MnSe, AlN and the like. Further, grain boundary segregation elements, such as Sb, As, Bi, Pb, Sn and the like, are occasionally used together with the inhibitor to enhance its effect. In order to form the effective recrystallization texture, a method wherein the hot rolling condition and the cold rolling condition are properly combined, is carried out, and a complicated step which consists of two cold rollings with an intermediate annealing between them, is carried out for this purpose.

While, a slab to be used as a starting material for the production of grain-oriented silicaon steel sheet has hitherto been produced from molten steel through ingot making and slabbing, but is recently produced directly from molten steel by the continuous casting. The defects in the crystal texture and recrystallization texture due to the use of the continuously cast slab causes troubles in the grain-oriented silicon steel sheet product. That is, when it is intended to obtain fine precipitates of MnS, MnSe, AlN and the like, which are effective as an inhibitor, it is necessary that a slab is heated at a high temperature of not lower than 1,250° C. for a long period of time before the hot rolling to dissociate and to solid solve fully the inhibitor element into the steel, and the cooling step at the hot rolling is controlled to precipitate the inhibitor element having a proper fine size. However, in the continuously cast slab, extraordinarily coarse crystal grains are apt to develop during the high temperature heating of the slab as described above, and incompletely developed secondary recrystallized texture called as fine grain streak is formed in the resulting silicon steel sheet product due to the extraordinarily coarse crystal grains, and the silicon steel sheet product is poor in the magnetic properties.

There have higherto been proposed several methods in order to prevent the formation of the above-described fine grain streak and to improve the magnetic properties. For example, Japanese Patent Laid-Open Application No. 119,126/80 discloses a method, wherein a slab is subjected to a recrystallization rolling when the slab is hot rolled into a given thickness, that is, the texture of the slab just before the recrystallization rolling is controlled such that $\alpha$-phase matrix contains at least 3% of precipitated $\gamma$-phase iron, and the slab is subjected to a recrystallization rolling at a high reduction rate of not less than 30% per one pass within the temperature range of 1,230°–960° C. The inventors have proposed in Japanese Patent Application No. 31,510/81 a method, wherein a slab is mixed with a necessary amount of C depending upon the Si content, and not less than a given amount of $\gamma$-phase iron is formed within a specifically limited temperature range during the hot rolling, whereby coarse crystal grains developed in the slab during the heating at high temperature are broken to prevent effectively the formation of fine grain streak in the product.

However, according to the above described method of forming not less than a given amount of $\gamma$-phase iron in a slab during its hot rolling, although formation of the fine grain streak in the product can be prevented, the aimed magnetic properties can be not always obtained, and moreover the prevention of the formation of the fine grain streak is very unstable, and fine grain texture may be formed all over the product to deteriorate noticeably its magnetic properties. Therefore, this method is still insufficient in the stability of the effect, which is a most important factor in the commercial production of grain-oriented silicon steel sheet.

SUMMARY OF THE INVENTION

The object of the present invention is to obviate the drawbacks of the above described conventional technics in the production of grain-oriented silicon steel sheet and to provide a method which can always produce stably the steel sheet having excellent magnetic properties.

That is, the feature of the present invention lies in a method of producing grain-oriented silicon steel sheets having excellent magnetic properties, comprising a step of hot rolling a silicon steel having a composition containing, in % by weight, 2.8–4.0% of Si, 0.02–0.15% of Mn and 0.008–0.080% of a total amount of at least one of S and Se into a hot rolled steel sheet, a step of coiling the hot rolled steel sheet, a step of subjecting the coiled steel sheet to two or more cold rollings with an intermediate annealing between them, wherein the final cold rolling is caused out at a reduction rate of 40–80%, to produce a finally cold rolled steel sheet having a final gauge, and steps of subjecting the finally cold rolled steel sheet to a decarburization annealing and then to a final annealing, an improvement comprising said silicon steel having a C content, depending upon the Si content, within the range defined by the following formula $$0.37[Si\%]+0.27 \leqq \log([C\%]\times 10^3) \leqq 0.37[Si\%]+0.57$$

wherein [Si%] and [C%] represent contents (% by weight) of Si and C in the steel, respectively; and removing 0.006–0.020% by weight of C from the steel during the course after the completion of the above described hot rolling and just before the beginning of the above described final cold rolling.

DESCRIPTION OF THE PREFERRED EMBODIMENT

The inventors have investigated the cause for giving unsable magnetic properties to grain-oriented silicon steel sheet in the above described conventional methods, and found out the following facts. That is, the γ-phase iron formed in a slab used as starting material during its hot rolling acts harmfully on the fine precipitates of MnS, MnSe and the like, which act as an inhibitor, and particularly the formation of an excessively large amount of γ-phase iron deteriorates greatly the effect of the inhibitor to disturb a sufficient development of secondary recrystallized grains. Further, even when a proper amount of γ-phase iron is formed, the γ-phase iron acts harmfully on the formation of proper crystal texture and recrystallization texture during the cold rolling step after the γ-phase iron has been utilized for dividing coarse crystal grains into small grain size during the hot rolling. The inventors have variously investigated how to overcome these harmful functions and have found out a novel method. As the result, the present invention has been accomplished.

The present invention will be explained referring to basic experimental data for the present invention.

Figure 1:
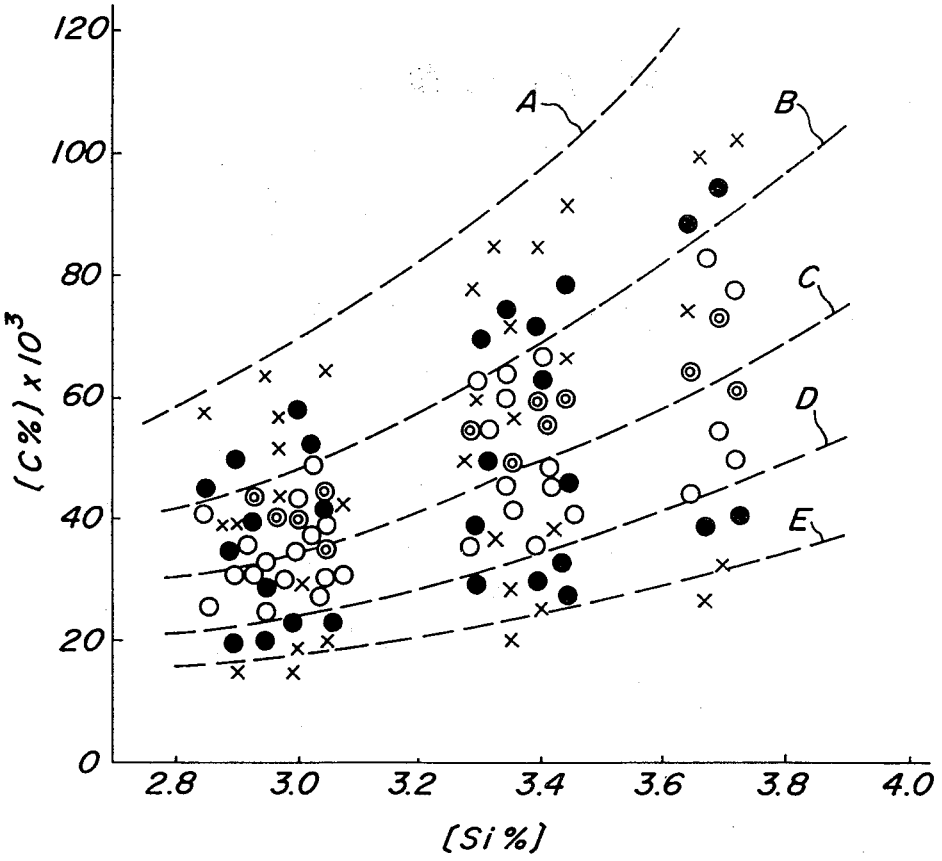
FIG. 1 is a graph illustrating the influences of the Si content and C content in a slab used as a starting material upon the iron loss value of a grain-oriented silicon steel sheet product in the basic experiment of the present invention.

FIG. 1 illustrates relations between the Si or C content in a slab used as a starting material and the iron loss $W_{17/50}$ of the resulting grain-oriented silicon steel sheet in the following experiment. A large number of slabs, which contained 0.015–0.035% (in the specification, "%" relating to the amount of composition of steel means "% by weight") of Se and 0.03–0.09% of Mn as an inhibitor, and contained Si in an amount within each of three groups of 2.8–3.1%, 3.3–3.5% and 3.6–3.8%, and C in a variant amount within the range of 0.01–0.10%, were produced from ingots, and each slab was heated at 1,400° C. for 1 hour and then hot rolled to produce a hot rolled sheet having a thickness of 2.5 mm, the hot rolled sheet was subjected to two cold rollings with an intermediate annealing between them to produce a finally cold rolled sheet having a final gauge of 0.30 mm, and the finally cold rolled sheet was subjected to a decarburization annealing and a final annealing to obtain the final product of grain-oriented silicon steel sheet. In the above described experiment, the atmosphere of the intermediate annealing was variously changed from decarburizing atmosphere to non-decarburizing atmosphere, and the final cold rolling reduction rate was set within the range of 50–70%. The broken lines A, B, C, D and E described in FIG. 1 represent estimated value, calculated from the following formula (1), of the amount of γ-phase iron to be formed at 1,150° C. in the slab during the hot rolling, and represent 40, 30, 20, 10 and 0%, respectively, of the estimated amount of the γ-phase iron to be formed. In general, the amount of γ-phase iron to be formed varies depending upon the Si and C contents in a slab and the heating temperature thereof. The following formula (1) was deduced from the measured values of the Si and C contents in a steel and the measured value of the amount of γ-phase iron formed in the steel under an equilibrium condition at 1,150° C. with respect to sample silicon steels containing various amounts of Si and C.

$$\gamma\% = 67 \log([C\%]\times 10^3) - 25[Si\%] - 8 \quad (1)$$

In formula (1), the value in the blackets [ ] represents % by weight of C and Si contents in the steel. The measured values of iron loss $W_{17/50}$ of the resulting steel sheets of the three groups of the simple steels classified by the Si content are shown in the following Table 1 and FIG. 1.

TABLE 1

| Iron loss (W/kg) | Marks in FIG. 1 | Range of [Si %] in sample steel 2.8–3.1% | 3.3–3.5% | 3.6–3.8% |
|---|---|---|---|---|
| $W_{17/50}$ | ◎ | ≦1.05 | ≦1.00 | ≦0.95 |
| | ○ | ≦1.10 | ≦1.05 | ≦1.00 |
| | • | ≦1.15 | ≦1.10 | ≦1.05 |
| | x | >1.15 | >1.10 | >1.05 |

It can be seen from Table 1 that, although there is a difference in the estimation standard of iron loss value between the three groups of sample steels, sample steels capable of giving low iron loss of $W_{17/50}$ to the resulting grain-oriented silicon steel sheets are present between broken lines B and D shown in FIG. 1, that is, the amount of γ-phase iron formed during the hot rolling of sample steels are present within the range of 10–30% independently of the Si content. However, the γ-phase iron formed during the hot rolling is not present under an equilibrium condition, but is present under a metastable condition, and it is difficult to determine accurately the amount of γ-phase iron formed at 1,150° C. during the actual hot rolling. Accordingly, the limitation of the proper range of C content in a steel, which gives low iron loss to the steel sheet product, by the formed amount of γ-phase iron is not proper for practical operation, and it is proper for practical operation that the proper range of C content in a steel, which range satisfy the range of 10–30% of the formed amount of γ-phase iron given by the above described formula (1), is limited depending upon the Si content. Based on this idea, the proper range of C content in a silicon steel used as a starting material for giving a low iron loss to the resulting grain-oriented silicon steel sheet, which C content varies depending upon the Si content in the steel, is given by the following formula (2)

$$0.37[Si\%]+0.27 \leqq \log([C\%]\times 10^3) \leqq 0.37[Si\%]+0.57 \quad (2)$$

This is a first equirement to be satisfied in the present invention.

Figure 2A:
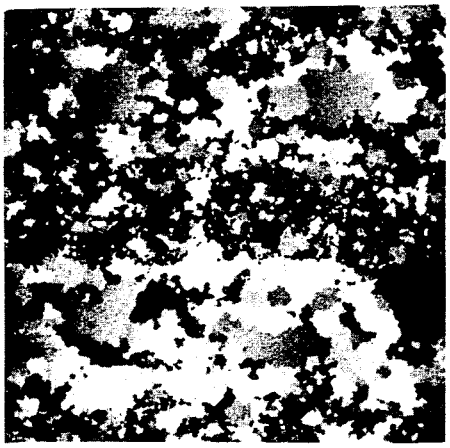
FIG. 2A is a microphotograph illustrating the fine grain streak of the product when the amount (estimated value) of γ-phase iron formed at 1,150° C. during the hot rolling of the slab is smaller than the lower limit of the proper range of 10–30%.

That is, when the C content in a starting steel is lower than the lower limit of the proper range of C content defined by the formula (2) depending upon the Si content, that is, when a starting steel has a composition which forms less than 10% of γ-phase iron during the hot rolling, the product has a distinct fine grain streak as illustrated in FIG. 2A, and is poor in the magnetic properties. While, when a starting steel has a composition which forms 10% shown by the line D in FIG. 1 or more of γ-phase iron, the product has substantially no fine grain streak and consists mainly of normally developed secondary recrystallized grains.

Accordingly, in order that coarse crystal grains developed extraordinarily during the heating of a slab at high temperature are divided into small grain size and broken during the hot rolling and that the development of fine grain streak is prevented, it is necessary to form not less than a given amount of γ-phase iron. It has been found out that this given amount of γ-phase iron can be formed by containing C to the slab in such an amount that can form not less than 10% of γ-phase iron, depending upon the Si content, during the hot rolling of the slab when the slab is kept under an equilibrium condition.

Figure 2B:
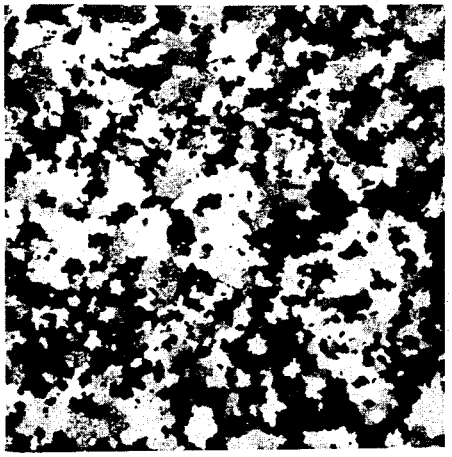
FIG. 2B is a microphotograph illustrating the heterogeneous texture, which consists of a mixture of fine grains and normally developed secondary recrystallized grains, and is formed in the case where the amount (estimated value) of γ-phase iron formed during the hot rolling of a slab at 1,150° C. is larger than the upper limit of the proper range of 10–30%.

While, when a slab contains an excessively large amount of C, that is, when a slab has a composition which forms more than 30% of γ-phase iron during the hot rolling, the product has a crystal texture which is wholly occupied by fine grains consisting of incompletely developed secondary recrystallized grains, and has very poor magnetic properties. When the excess amount of C approaches the upper limit of the range of the proper C content determined depending upon the Si content, the crystal texture of the product is varied to a so-called heterogeneous texture consisting of a mixture of fine grains and normally developed secondary recrystallized grains as illustrated in FIG. 2B, and the magnetic properties are somewhat improved but are still insufficient.

The reason why the development of secondary recrystallized grains is disturbed by the excess amount of C beyond the upper limit of the proper range of C content represented by the above described formula (2) is not clear, but is probably as follows. That is, due to the lowering of temperature of a slab during its hot rolling following to the high temperature heating thereof, the amount of C solid solved in the α-phase iron is decreased to form in the steel the γ-phase iron having a high C content, and the amount of the γ-phase iron increases until the maximum amount of γ-phase iron is formed at about 1,150° C. This γ-phase iron has a very high C content of not less than about 0.2%, which is higher than the C content in the α-phase iron. Therefore, inhibitors of S and Se, which have been dissociated and solid solved in the α-phase iron during the high temperature heating of the slab, become difficult to be solid solved in the γ-phase iron. Accordingly, it can be guessed that S and Se are precipitated and grown into coarse grains during the initial high temperature stage of hot rolling to lose their effect as an inhibitor.

Based on the above described mechanism, when γ-phase iron formed during the hot rolling of a slab exceeds a certain value, the amount of a region, which is not suitable for the presence of an inhibitor, based on the total steel sheet is increased to cause incomplete development of secondary recrystallized grains, and a product having excellent magnetic properties can not be obtained.

As the result, the inventors have found out the following fact. Only when the silicon steel to be used in the present invention contains C and Si in such amounts that can form 10–30% of γ-phase iron under an equilibrium condition during the hot rolling, the object of the present invention can be attained, and it is very effective in order to obtain a product having excellent magnetic properties that the silicon steel has a C content defined by the above described formula (2) depending upon the Si content.

However, even when the formed amount of γ-phase iron shown in FIG. 1 is within the range of 10–30%, some of the resulting grain-oriented silicon steel sheets have not a satisfactorily low iron loss, and the limitation of only Si and C contents defined by the formula (2) is still in sufficient in order to produce silicon steel sheets having stable magnetic properties in a commercial scale. The inventors have made various investigations in order to obviate this drawback, and formed out that it is very effective to remove 0.006–0.020% of C from the steel during the course after completion of the hot rolling and before completion of the intermediate annealing carried out before the final cold rolling in order to obtain stably a product having excellent magnetic properties. This is a second requirement to be satisfied in the present invention.

Figure 3A:
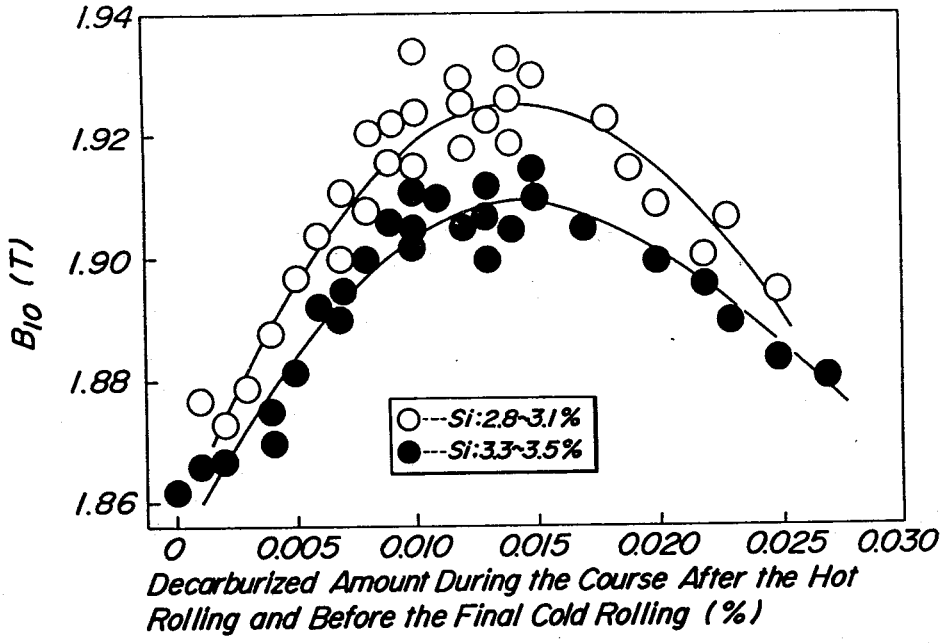
FIG. 3A is a graph illustrating the influence of the decarburized amount ΔC during the course after the hot rolling and before the final cold rolling upon the magnetic induction $B_{10}$.
Figure 3B:
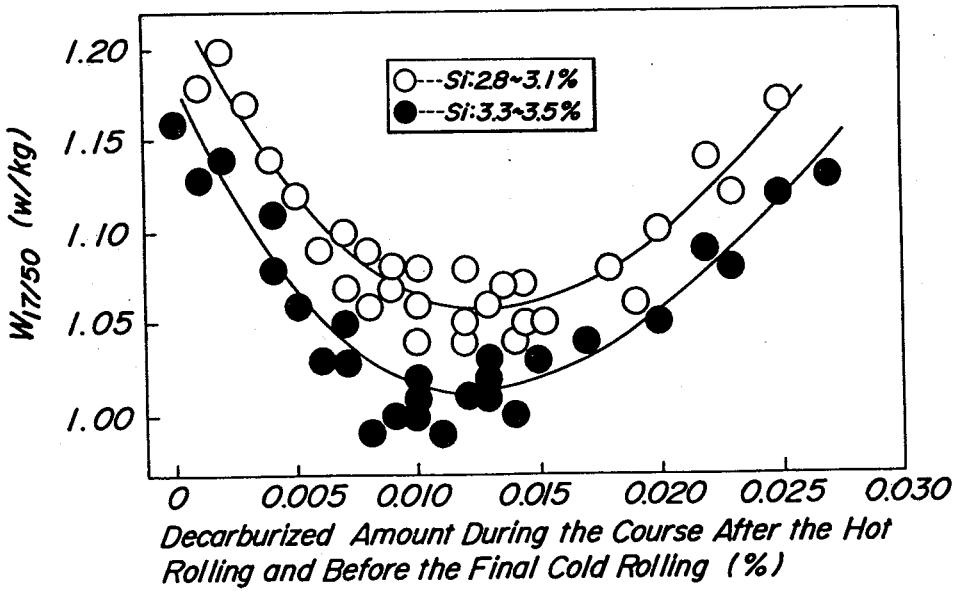
FIG. 3B is a graph illustrating the influence of the decarburized amount ΔC during the course after the hot rolling and before the final cold rolling upon the iron loss value $W_{17/50}$.

This second requirement has been ascertained by the inventors from the following experiment. That is, grain-oriented silicon steel sheets were produced from slabs having a composition which had an Si content within each of the two groups of 2.8–3.1% and 3.3–3.5% shown in FIG. 1 and had such a C content (which depends upon the Si content) that corresponded to 10–30% of the amount of γ-phase iron to be formed at 1,150° C. during the hot rolling of the slab, and the relation between the magnetic properties of the products and the difference in the C content between the hot rolled sheet and the intermediately annealed sheet before final cold rolling, that is, the relation between the magnetic properties and the decarburized amount (ΔC), was investigated. FIGS. 3A and 3B show the result. FIGS. 3A and 3B are graphs illustrating the relations between the decarburized amount during the course, which is carried out after the hot rolling and before the final cold rolling, and the magnetic induction $B_{10}$(T) and the iron loss $W_{17/50}$, respectively, in a large number of sample steels having an Si content of the group of 2.8–3.1% shown by white circles or having an Si content of the group of 3.3–3.5% shown by black circles in FIGS. 3A and 3B. It can be seen from FIGS. 3A and 3B that, when the decarburized amount ΔC is not less than 0.006% and not more than 0.020%, excellent magnetic properties aimed in the present invention can be stably obtained. While, when ΔC is less than 0.006% or more than 0.020%, the magnetic induction is low and the iron loss is relatively large, and these values are insufficient as the magnetic properties aimed in the present invention.

The decarburized amount during the course after the hot rolling and before the final cold rolling in an ordinary operation is generally 0.005% or less. Therefore, the decarburized amount of 0.006–0.020%, which has been found out to be an effective amount in the present invention, means that the treatments carried out during the course after the hot rolling and before the final cold rolling must be carried out under a particularly limited condition. The magnetic properties, which have not been satisfactorily improved by the above described first requirement of the present invention, can be satisfactorily improved by this second requirement of the present invention, wherein a decarburization is forcedly carried out during the course after the hot rolling and before the final cold rolling, and excellent magnetic properties can be stably obtained.

The inventors have made the following experiment in order to investigate the reason why the above described removal of a proper amount of C during the course after the hot rolling and before the final cold rolling is effective in order to improve stably magnetic properties.

That is, the sample steels used in the experiment shown in FIGS. 3A and 3B were classified into the following three groups corresponding to the decarburized amount.

Figure 4A:
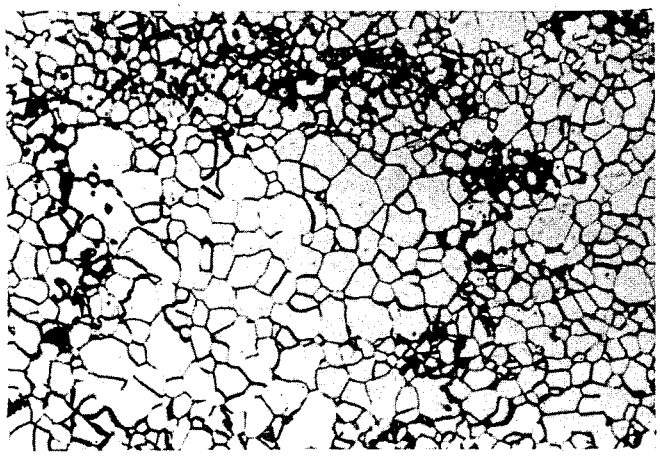
FIG. 4A is a microphotograph illustrating a primarily recrystallized texture of a steel before the final cold rolling in the case where the decarburized amount ΔC is 0.005% or less and is short with respect to the amount ΔC to be decarburized of 0.006–0.020%, which is defined as one of the requirements in the present invention.
Figure 4B:
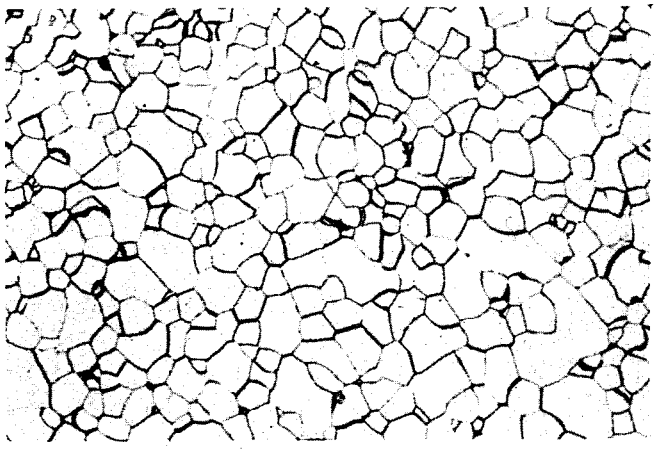
FIG. 4B is a microphotograph illustrating a primarily recrystallized texture of a steel in the case where the decarburized amount ΔC is nearly equal to 0.010% and is proper.
Figure 4C:
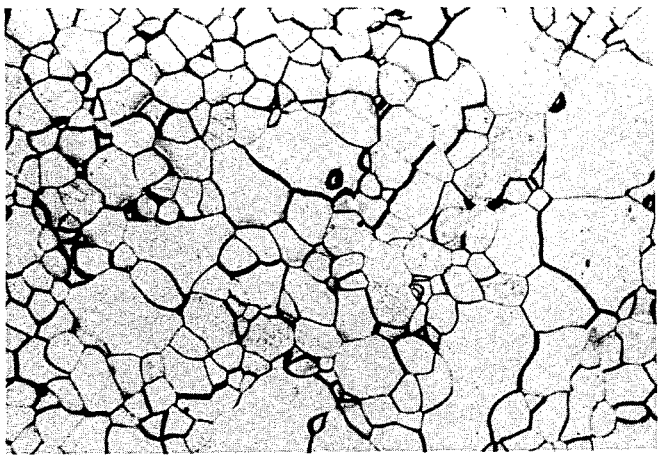
FIG. 4C is a microphotograph illustrating a primarily recrystallized texture of a steel before the final cold rolling in the case where the decarburized amount ΔC is 0.021% or more and is excess.
Figure 5A:
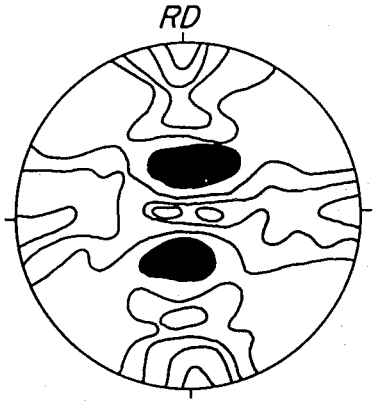
FIGS. 5A, 5B and 5C are {200} pole figures of the steels having the primarily recrystallized textures shown in FIGS. 4A, 4B and 4C, respectively.
Figure 5B:
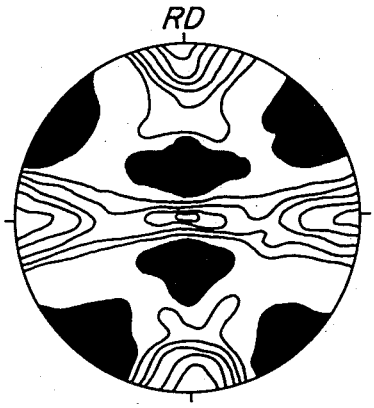
Figure 5C:
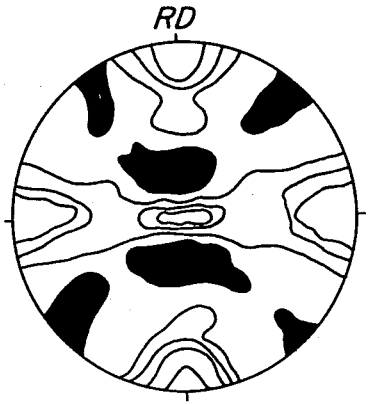
Figure 6A:
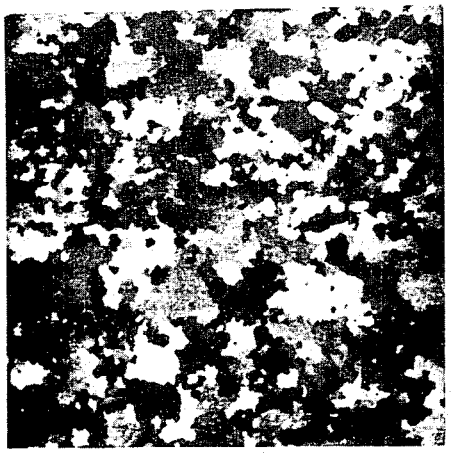
FIGS. 6A, 6B, and 6C are microphotographs illustrating the crystal textures of silicon steel sheets produced from the steels having the primarily recrystallized textures shown in FIGS. 4A and 5A; 4B and 5B; and 4C and 5C, respectively.
Figure 6B:
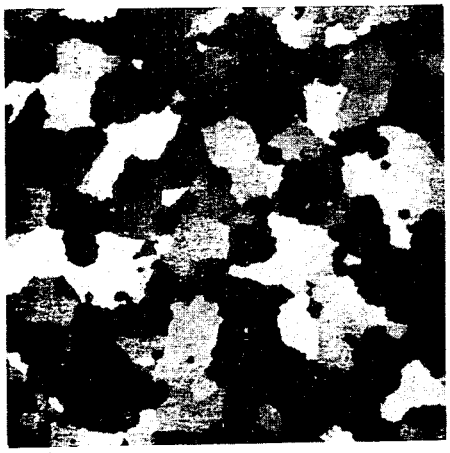
Figure 6C:
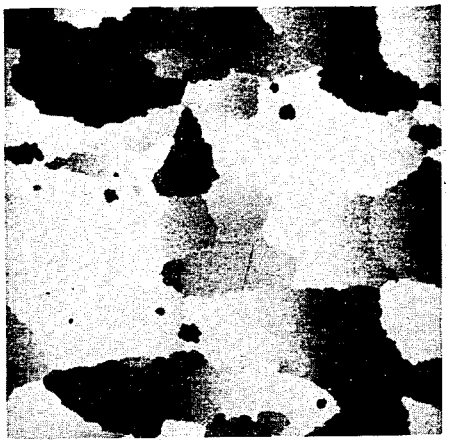

(A) Decarburized amount is short: $\Delta C \leqq 0.005\%$ (B) Decarburized amount is proper: $\Delta C \cong 0.010\%$ (C) Decarburized amount is excess: $\Delta C \geqq 0.021\%$ FIGS. 4A, 4B and 4C illustrate the primarily recrystallized textures, after the intermediate annealing before the final cold rolling, of the above described sample steels (A), (B) and (C), respectively; FIGS. 5A, 5B and 5C are {200} pole figures illustrating the primarily recrystallized recrystallization texture of the sample steels (A), (B) and (C), respectively; and FIGS. 6A, 6B and 6C are microphotographs illustrating the crystal texture of the products in the above described sample steels (A), (B) and (C), respectively.

It can be seen from FIGS. 4A through 6C that, in the sample steel (A) wherein the decarburized amount is short, the primarily recrystallized texture before the final cold rolling has not a uniform crystal grain size, and fine grains are formed into massive and distributed in the texture as illustrated in FIG. 4A, and further the recrystallization texture is an unfavorable microstructure, wherein the intensity of secondary recrystallized grains having a (110)[001] orientation is low and crystal grains having a relatively strong $\{111\}\langle 11\bar{2}\rangle$ orientation are dispersed as illustrated in FIG. 5A. As the result, the crystal texture of the product is a mixed texture formed of fine grains and incompletely developed secondary recrystallized grains as illustrated in FIG. 6A.

While, in the sample steel (B), wherein the decarburized amount is proper, the crystal grain size before the final rolling is uniform and proper as illustrated in FIG. 4B, and the recrystallization texture is a favorable texture wherein the intensity of secondary recrystallized grains having a (110)[001] orientation is high as illustrated in FIG. 5B. Moreover, the crystal texture of the product are formed of normally and fully developed secondary recrystallized grains as illustrated in FIG. 6B.

Further, in the sample steel (C), wherein the decarburized amount is excess, the crystal grain size before the final cold rolling is not uniform and coarse crystal grains are dispersed as illustrated in FIG. 4C, and the recrystallization texture is unfavorable due to the development of a small amount of recrystallized grains having a (110)[001] orientation as illustrated in FIG. 5C. Therefore, the crystal texture of the product resulted from such recrystallization texture is occupied by extraordinarily coarse secondary recrystallized grains as illustrated in FIG. 6C, and many of these secondary recrystallized grins have orientations somewhat deviated from the (110)[001] orientation, and the product is insufficient in the magnetic properties.

As described above, it has seen found that the γ-phase iron, which have acted effectively on a slab in the hot rolling step in order to divide and break coarse grains contained in the slab, is dispersed in the slab in the form of coarse massive carbide during the cold rolling step, and ununiform crystal texture and unfavorable recrystallization texture are formed in the surrounding of the coarse massive carbide. According to the present invention, the above described massive carbide is eliminated by the removal of a proper amount of carbon, whereby favorable crystal texture and recrystallization texture can be obtained. However, when the decarburized amount is short or excess, the obtained crystal texture is not uniform and is not favorable, and a recrystallization texture having an intense (110)[001] orientation aimed in the present invention can not be obtained.

The inventors have ascertained the following fact in the further investigation. The amount of C necessary for forming γ-phase iron during the hot rolling step is larger than the proper amount of C for the cold rolling step and is harmful for obtaining an aimed product having excellent magnetic properties. In order to obviate this drawback, it is necessary that 0.006–0.020% of C is removed from steel which has originally contained C in an amount necessary for forming γ-phase iron.

Then, an explanation will be made with respect to the limitation of the composition of the silicon steel to be used in the present invention.

Si:

When the Si content is lower than 2.8%, a sufficiently low iron loss value aimed in the present invention can not be obtained. While, when the Si content is higher than 4.0%, the steel is brittle, is poor in the cold rollability, and is difficult to be cold rolled by a commonly used commercial rolling operation. Therefore, the Si content is limited within the range of 2.8–4.0%. As the Si content is higher within this range of 2.8–4.0%, products having a low iron loss can be generally obtained. In the practical operation, the use of a steel having a high Si content is expensive due to Si and further decreases the yield of cold rolling, resulting in the very expensive product. Therefore, the Si content should be properly selected depending upon the aimed level of iron loss.

C:

It has been already explained as the first requirement of the present invention that the C content must be adjusted to the range defined by the above described formula (A) depending upon the Si content. That is, it is necessary that the C content is limited to the range which corresponds substantially to 10–30% of the amount of $\gamma$-phase iron to be formed at 1,150° C. during the hot rolling as illustrated in FIG. 1. Concrete values of the Si content and C content are show in the following Table 2.

TABLE 2

| Si % | C % |
|---|---|
| 3.0 | 0.024–0.048 |
| 3.5 | 0.038–0.075 |
| 4.0 | 0.058–0.115 |

However, when the C content exceeds 0.1%, a long time is required for the decarburization step, and is expensive. Therefore, it is desirable that a necessary amount of C is selected within the range not larger than 0.1%.

Mn, S and Se:

Mn, S and Se are added to steel as an inhibitor, and are necessary elements in order to suppress the development of primarily recrystallized grains during the final annealing and to develop secondary recrystallized grains predominantly having a (110)[001] orientation. However, when the amount of Mn is outside the range of 0.02–0.15% or the total amount of at least one of S and Se is outside the range of 0.008–0.08%, the development of secondary recrystallized grains is unstable, and excellent magnetic properties aimed in the present invention can not be obtained. Therefore, the contents of Mn, S and Se are limited within the above described ranges.

The silicon steel to be used in the present invention consists essentially of the above described elements and the remainder being substantially Fe and incidental impurities. The steel may contain occasionally grain boundary segregation type elements, such as Sb, As, Bi, Pb, Sn and the like, alone or in admixture to promote the effect of the inhibitor. In the present invention, the use of the grain boundary segregation type element does not deteriorate the magnetic properties of the steel sheet product.

Then, an explanation will be made with respect to the reason why the rolling condition is limited in the present invention.

As silicon steel slab having the above described limited composition is heated to a high temperature generally not lower than 1,250° C., hot rolled by a commonly known method to produce a hot rolled steel sheet having a thickness of 1.2–5.0 mm, and then coiled. The coiled steel sheet is subjected to two or more cold rollings with an intermediate annealing between them, wherein the final cold rolling is carried out at a reduction rate of 40–80%, to produce a finally cold rolled sheet having a final gauge of 0.15–0.50 mm. The intermediate annealing is carried out at a temperature within the range of 750°–1,100° C. In general, two or more cold rollings with an intermediate annealing between them are carried out to produce a finally cold rolled sheet having a final gauge. The reason why the final cold rolling reduction rate is limited to 40–80% is as follows. In the present invention, a proper amount of C is removed from the steel during the course of the cold rolling to uniformalize the crystal texture and to promote the development of secondary recrystallized grains having a (110)[001] orientation in the recrystallization texture. This effect can not be attained by less than 40% or more than 80% of final cold rolling reduction rate, but can be attained only when the final cold rolling reduction rate is within the range of 40–80%.

The resulting finally cold rolled sheet is subjected to a decarburization annealing and then to a final annealing to obtain a product.

The method of the present invention will be explained in order to production steps hereinafter.

The slab to be used as a starting material in the present invention may be a slab produced by a conventional ingot making-slabbing method or a slab produced by a continuous casting method. The slab is heated to a high temperature of not lower than 1,250° C., subjected to a hot rolling by a commonly known method to produce a hot rolled steel sheet having a thickness of 1.2–5.0 mm, and then coiled.

When the decarburization treatment is carried out without carrying out the normalizing annealing, a product having magnetic properties superior to those obtained by conventional methods can be obtained. That is, this process has both merits that the production steps are simple and that the magnetic properties are excellent.

It is important in the present invention that the decarburization treatment is carried out and further the normalizing annealing is carried out. In this case, a product having magnetic properties superior to those obtained by the above described process, wherein the normalizing annealing is not carried out.

The above obtained coiled sheet, directly or after subjected to a normalizing annealing, is subjected to two or more cold rollings with an intermediate annealing between them at a temperature of 750°–1,100° C. to obtain a finally cold rolled sheet having a final gauge of 0.15–0.50 mm.

During the above described steps, 0.006–0.020% of C is removed from the steel during the course after the hot rolling and before the final cold rolling.

As the decarburization treatment, there can be used a method wherein the hot rolled sheet is applied with $Fe_2O_3$ or other oxide, coiled and the decarburization is promoted by utilizing the self-annealing; and a method wherein the hot rolled sheet is coiled and immediately placed in a box kept under a decarburizing atmosphere to promote the decarburization. Further, the decarburization treatment can be carried out in at least one of the above described normalizing annealing step and intermediate annealing step. The decarburization treatment in the normalizing annealing step or in the intermediate annealing step can be easily carried out by adjusting properly the atmosphere of commonly known continuous annealing furnace. The strength of the decarburizing ability of the annealing atmosphere at the decarburization should be properly adjusted depending upon the composition of the starting slab, sheet thickness, annealing time and the like. Among the above described decarburization treatments, the decarburization at the intermediate annealing step is most advantageous due to the reason that the decarburizing amount can be easily adjusted and is uniform due to the small sheet thickness and further the ordinary annealing atmosphere can be easily made into a decarburizing atmosphere, whereby the object of the present invention can be easily attained and the installation cost and production cost are low.

The above described hot rolled sheet is cold rolled as described above. In this cold rolling, the final cold rolling is carried out at a reduction rate of 40–80% to promote the formation of uniform crystal texture and the development of secondary recrystallized grains having a (110)[001] orientation in the recrystallization texture.

The finally cold rolled sheet, which has a C content lower by 0.006–0.020% than the amount of C contained in the starting slab, is further subjected to a decarburization annealing at a temperature with the range of 750°–850° C. under a wet hydrogen atmosphere to decrease fully the C content to not more than 0.003%. Then, an annealing separator, such as MgO or the like, is applied to the decarburized sheet, and the above treated sheet is subjected to a final annealing. The final annealing is carried out in order to develop fully secondary recrystallized grains having a (110)[001] orientation and at the same time to remove S and Se, which have previously added to the slab as an inhibitor, and other impurity elements, such as N and the like, and to purify the sheet. The final annealing is generally carried out at a high temperature not lower than 1,000° C. However, it is most preferable to carry out the final annealing according to a method disclosed by the inventors in U.S. Pat. No. 3,932,234, wherein the sheet applied with an annealing separator is kept at a temperature within the range of 820°–920° C., which develops secondary recrystallized grains, for at least about 10 hours to develop fully secondary recrystallized grains, and successively subjected to a purification annealing at a temperature not lower than 1,000° C. in order to remove the impurities. Grain-oriented silicon steel sheets having excellent magnetic properties can be stably produced through the above described treating steps of the present invention.

The following examples are given for the purpose of illustrating of this invention and are not intended as limitations thereof.

EXAMPLE 1

A molten steel having a composition, which contained 3.15% of Si and three levels of 0.021, 0.045 or 0.072% of C, and further contained 0.07% of Mn, 0.03% of Se and 0.03% of Sb as an inhibitor; or a composition, which contained 3.60% of Si and three levels of 0.033, 0.058 or 0.094% of C, and further contained 0.07% of Mn, 0.03% of Se and 0.03% of Sb as an inhibitor, was continuously cast into two or three slabs, each having a thickness of 200 mm. The slab was heated at 1,380° C. for 1 hour, hot rolled into a thickness of 2.5 mm, and then coiled. The hot rolled and coiled sheet was annealed at 980° C. for 30 seconds, and then cold rolled into a thickness of 0.75 mm. Successively, the sheet was subjected to a continuous intermediate annealing at 950° C. for 2 minutes under an atmosphere of $P_{H2O}/P_{H2}=0.003–0.35$ by a commonly known method so as to remove 0.002–0.030% (decarburized amount ΔC) of carbon, and then finally cold rolled at a reduction rate of 60% into a final gauge of 0.30 mm. The finally cold rolled sheet was subjected to a decarburization annealing at 800° C. in wet hydrogen, applied with an annealing separator consisting mainly of MgO, subjected to a final annealing at 1,200° C. for 10 hours, and then applied with an insulating coating to produce a grain-oriented silicon steel sheet.

The magnetic properties of the products are shown in the following Table 3. In Table 3, the value in the parentheses under the heading of C content in slab indicates the amount (estimated value) of γ-phase iron formed in the steel at 1,150° C. during the hot rolling.

TABLE 3

| | Slab (wt. %) | | | | | |
|---|---|---|---|---|---|---|
| Sample steel No. | Si | C | Decarburized amount ΔC | $W_{17/50}$ (W/kg) | $B_{10}$ (T) | Remarks |
| 1 | | 0.021 | 0.002 | 1.14 | 1.87 | Comparative |
| 2 | | ( 2%) | 0.007 | 1.12 | 1.88 | steel |
| 3 | | | 0.003 | 1.12 | 1.88 | |
| 4 | 3.15 | 0.045 (24%) | 0.012 | 1.02 | 1.93 | Steel of this invention |
| 5 | | | 0.025 | 1.14 | 1.89 | Comparative |
| 6 | | 0.072 | 0.015 | 1.22 | 1.83 | steel |
| 7 | | (38%) | 0.030 | 1.25 | 1.82 | |
| 8 | | 0.033 | 0.003 | 1.11 | 1.86 | Comparative |
| 9 | | ( 4%) | 0.010 | 1.09 | 1.86 | steel |
| 10 | | | 0.004 | 1.08 | 1.87 | |
| 11 | 3.60 | 0.058 (20%) | 0.009 | 0.97 | 1.91 | Steel of this invention |
| 12 | | | 0.024 | 1.06 | 1.88 | Comparative |
| 13 | | | 0.005 | 1.23 | 1.78 | steel |
| 14 | | 0.094 (34%) | 0.013 | 1.18 | 1.80 | |
| 15 | | | 0.025 | 1.16 | 1.82 | |

It can be seen from Table 3 that, in comparative steels of sample Nos. 1, 2, 6, 7, 8, 9, 13, 14 and 15, which do not satisfy any one of the requirements of the present invention, the iron loss value is high and the magnetic induction is low. That is, in sample steel Nos. 1, 2, 8 and 9, the C content in the slab is lower than the lower limit of the range defined in the present invention, and the formed amount of γ-phase iron is smaller than the lower limit of the proper range of 10–30% defined in the present invention, and accordingly, a fine grain streak is formed as illustrated in FIG. 2A. While, in sample steel Nos. 6, 7, 13, 14 and 15, the C content in the slab is higher than the upper limit of the range defined in the present invention, and the formed amount of γ-phase iron is larger than the upper limit of the proper range of 10–30% defined in the present invention, and accordingly the crystal texture consists of a mixture of fine grains and normally developed secondary recrystallized grains as illustrated in FIG. 2B, and the products have a high iron loss value and a low magnetic induction.

Further, in sample steel Nos. 2, 6 and 9, the product has a slightly improved magnetic induction due to the reason that the decarburized amount ΔC is within the range of 0.006–0.020% defined in the present invention, but the product has not satisfactorily improved magnetic properties due to the reason that the C content in the slab does not satisfy the requirement defined in the present invention.

Further, even when the formed amount of γ-phase iron is within the proper range of 10–30% defined invention and at the same time the C content in the slab satisfies the above described formula (2) defined in the present, if the decarburized amount ΔC is not within the range of 0.006–0.020% defined in the present invention, a product having a satisfactorily low iron loss value and a satisfactorily high magnetic induction can not be obtained as illustrated in sample steel Nos. 3, 5, 10 and 12.

On the contrary, in sample steel Nos. 4 and 11, which satisfy all the requirements defined in the present invention, the product has a satisfactorily low iron loss value and at the same time a satisfactorily high magnetic induction, and has a fully developed secondary recrystallized texture as illustrated in FIG. 6B, and proves clearly the effect of the present invention.

EXAMPLE 2

Three slabs containing 3.35% of Si, 0.050% of C, 0.05% of Mn and 0.015% of S and having a thickness of 200 mm were heated at 1,350° C. for 1 hour, hot rolled into a thickness of 2.0 mm and then coiled. These hot rolled and coiled sheets were annealed at 1,000° C. for 30 seconds, cold rolled into a thickness of 0.75 mm, subjected to a continuous intermediate annealing at 950° C. for 2 minutes under a atmosphere of $P_{H2O}/P_{H2}=0.0$-03–0.35 by a commonly known method so as to remove 0.002%, 0.013% or 0.025% (decarburized amount ΔC) of carbon, and then finally cold rolled into a final gauge of 0.30 mm. The finally cold rolled sheets were subjected to a decarburization annealing at 800° C. in wet hydrogen, applied with an annealing separator consisting mainly of MgO, subjected to a final annealing at 1,200° C. for 10 hours, and then applied with an insulating coating to obtain grain-oriented silicon steel sheets according to the present invention.

The magnetic properties of the products are shown in the following Table 4.

TABLE 4

| Sample steel No. | Slab (wt. %) Si | C | Decarburized amount ΔC | $W_{17/50}$ (W/kg) | $B_{10}$ (T) | Amount of fine grains (%) | Remarks |
|---|---|---|---|---|---|---|---|
| 17 | | | 0.002 | 1.16 | 1.87 | 30 | Comparative steel |
| 18 | 3.35 | 0.050 | 0.013 | 1.00 | 1.93 | 0 | Steel of this invention |
| 19 | | | 0.025 | 1.13 | 1.89 | 0 | Comparative steel |

It can be seen from Table 4 that, in sample steel No. 17, whose decarburized amount ΔC is 0.002%, which is less than the lower limit of the range defined in the present invention, the texture of the resulting steel sheet contains 30% of fine grains, and a large amount of fine grains is developed, and a satisfactorily low iron loss value can not be obtained although the formed amount (estimated value) of γ-phase iron is within the proper range of 10–30%. Further, in sample steel No. 19, whose decarburized amount ΔC is excessively large and 0.025%, the texture of the resulting steel sheet contains no fine grains, but secondary recrystallized grains are coarse. As the result, the sheet of sample steel No. 19 has a satisfactorily high magnetic induction, but has not a satisfactorily low iron loss value. On the contrary, in sample steel No. 18 which satisfies all the requirements defined in the present invention, the resulting steel sheet has a low iron loss value and at the same time has a high magnetic induction. Therefore, according to the present invention, a satisfactory grain-oriented silicon steel sheet can be obtained.

EXAMPLE 3

Three continuously cast slabs of 200 mm thickness having a composition containing 3.0% of Si, 0.040% of C, 0.07% of Mn and 0.03% of Se were heated at 1,320° C. for 1 hour, hot rolled into a thickness of 3.0 mm, and then coiled. The hot rolled and coiled sheets were subjected to a normalizing annealing at 980° C. for 30 seconds and then cold rolled into a thickness of 0.80 mm, successively subjected to an intermediate annealing at 950° C. for 2 minutes under an atmosphere of $P_{H2O}/P_{H2}=0.003$–0.35 by a commonly known method so as to remove 0.003%, 0.012% or 0.024% (decarburized amount ΔC) of carbon, and then finally cold rolled into a final gauge of 0.30 mm. The finally cold rolled sheets were subjected to a decarburization annealing, and then to a final annealing at 1,200° C. for 10 hours. The finally annealed sheets were applied with an insulating coating to obtain grain-oriented silicon steel sheets. The magnetic properties of the products are shown in the following Table 5.

TABLE 5

| Sample steel No. | Slab (wt. %) Si | C | Decarburized amount ΔC | $W_{17/50}$ (W/kg) | $B_{10}$ (T) | Amount of fine grains (%) | Remarks |
|---|---|---|---|---|---|---|---|
| 20 | | | 0.003 | 1.19 | 1.88 | 15 | Comparative steel |
| 21 | 3.0 | 0.040 | 0.012 | 1.03 | 1.95 | 0 | Steel of this invention |
| 22 | | | 0.024 | 1.16 | 1.90 | 0 | Comparative steel |

It can be seen from Table 5 that, in sample steel No. 20, whose decarburized amount ΔC is less than the lower limit of the range of 0.006–0.020% defined in the present invention, the texture of the resulting steel sheet contains 15% of fine grains, and a low iron loss value can not be obtained and moreover the magnetic induction is low; while, in sample steel No. 22, whose decarburized amount ΔC is 0.024% which is more than the upper limit of the above described range, although the texture of the resulting steel sheet does not contain fine grains, a sufficiently low iron loss value can not be obtained.

On the contrary, in sample steel No. 21, whose decarburized amount is within the range defined in the present invention and which satisfies the other requirements, the resulting steel sheet has a satisfactorily low iron loss value and a very high magnetic induction.

EXAMPLE 4

Three continuously cast slabs of 200 mm thickness having a composition containing 3.0% of Si, 0.040% of C, 0.07% of Mn and 0.025% of S were heated at 1,320° C. for 1 hour, hot rolled into a thickness of 3.0 mm, and then coiled. The hot rolled and coiled sheets were pickled, cold rolled into a thickness of 0.8 mm, successively subjected to an intermediate annealing at 900° C. for 5 minutes under an atmosphere of $P_{H2O}/P_{H2}=0.003-0.35$ by a commonly known method so as to remove 0.003%, 0.012% or 0.024% (decarburized amount ΔC) of carbon, and then finally cold rolled into a final gauge of 0.30 mm. The finally cold rolled sheets were subjected to a decarburization annealing, and then to a final annealing at 1,200° C. for 10 hours. The finally annealed sheets were applied with an insulating coating to obtain grain-oriented silicon steel sheets. The magnetic properties of products are shown in the following Table 6.

TABLE 6

| Sample steel No. | Slab (wt. %) Si | C | Decarburized amount ΔC | $W_{17/50}$ (W/kg) | $B_{10}$ (T) | Amount of fine grains (%) | Remarks |
|---|---|---|---|---|---|---|---|
| 23 | | | 0.003 | 1.28 | 1.87 | 15 | Comparative steel |
| 24 | 3.0 | 0.040 | 0.012 | 1.15 | 1.88 | 0 | Steel of this invention |
| 25 | | | 0.024 | 1.29 | 1.83 | 0 | Comparative steel |

It can be seen from Table 6 that, in sample steel No. 23, whose decarburized amount ΔC is less than the lower limit of the range of 0.006–0.20% defined in the present invention, the texture of the resulting steel sheet contains 25% of fine grains, and a low iron loss value can not be obtained and moreover the magnetic induction is low; while, in sample steel No. 25, whose decarburized amount ΔC is 0.024% which is more than the upper limit of the above described range, although the texture of the resulting steel sheet does not contain fine grains, a sufficiently low iron loss value can not be obtained.

On the contrary, in sample steel No. 24, whose decarburized amount is within the range defined in the present invention and which satisfies the other requirements, the resulting steel sheet has a satisfactorily low iron loss value and a very high magnetic induction.

In a conventional method, wherein a normalizing annealing is carried out, the resulting steel sheet generally has magnetic properties of about $W_{17/50}=1.19-1.26$ and $B_{10}=1.83-1.86$. While, according to the present invention, a steel sheet having magnetic properties, which are superior to those of the above described steel sheet produced by carrying out a normalizing annealing in a conventional method, can be obtained even when a normalizing annealing is not carried out as illustrated in sample steel No. 24.

EXAMPLE 5

Three continuously cast slabs of 200 mm thickness having a composition containing 3.0% of Si, 0.040% of C, 0.07% of Mn and 0.025% of S were heated at 1,320° C. for 1 hour, hot rolled into a thickness of 3.0 mm, and then coiled. The hot rolled and coiled sheets were subjected to a normalizing annealing at 980° C. for 30 seconds, cold rolled into a thickness of 0.80 mm, successively subjected to an intermediate annealing at 950° C. for 2 minutes under an atmosphere of $P_{H2O}/P_{H2}=0.003-0.35$ by a commonly known method so as to remove 0.003%, 0.012% or 0.024% (decarburized amount ΔC) of carbon, and then finally cold rolled into a final gauge of 0.30 mm. The finally cold rolled sheets were subjected to a decarburization annealing, and then to a final annealing at 1,200° C. for 10 hours. The finally annealed sheets were applied with an insulating coating to obtain grain-oriented silicon steel sheets. The magnetic properties of the products are shown in the following Table 7.

TABLE 7

| Sample steel No. | Slab (wt. %) Si | C | Decarburized amount ΔC | $W_{17/50}$ (W/kg) | $B_{10}$ (T) | Amount of fine grains (%) | Remarks |
|---|---|---|---|---|---|---|---|
| 26 | | | 0.003 | 1.25 | 1.83 | 15 | Comparative steel |
| 27 | 3.0 | 0.040 | 0.012 | 1.13 | 1.89 | 0 | Steel of this invention |
| 28 | | | 0.024 | 1.25 | 1.85 | 0 | Comparative steel |

It can be seen from Table 7 that, in sample steel No. 26, whose decarburized amount ΔC is less than the lower limit of the range of 0.006–0.020% defined in the present invention, the texture of the resulting steel sheet contains 15% of fine grains, and a low iron loss value can not be obtained and moreover the magnetic induction is low; while, in sample steel No. 28, whose decarburized amount ΔC is 0.024% which is more than the upper limit of the above described range, although the texture of the resulting steel sheet does not contain fine grains, a sufficiently low iron loss value can not be obtained.

On the contrary, in sample steel No. 27, whose decarburized amount is within the range defined in the present invention and which satisfies the other requirements, the resulting steel sheet has a satisfactorily low iron loss value and a very high magnetic induction.

EXAMPLE 6

Three slabs of 200 mm thickness having a composition containing 3.3% of Si, 0.048% of C, 0.05% of Mn, 0.03% of Se and 0.03% of Sb were produced by a continuous casting of a molten steel, heated at 1,380° C. for 1 hour, hot rolled into a thickness of 2.5 mm, and then coiled. Immediately, the coiled sheets were subjected to a hot rolled sheet-annealing at 750° C. for 5 hours in boxes, the atmospheres in the boxes being kept to different three levels. In sample steel No. 29, the coiled sheet was treated in a dry $N_2$ atmosphere, and 0.003% of C was removed. In sample steel No. 30, the coiled sheet was annealed in air having a dew point of 20° C., and 0.013% of C was removed. In sample steel No. 31, the coiled sheet was annealed in air having a dew point of 40° C., and 0.026% of C was removed. Then, the above treated coiled sheets were subjected to a normalizing annealing at 980° C. for 30 seconds, cold rolled into a thickness of 0.75 mm, successively subjected to an intermediate annealing at 950° C. for 2 minutes, and then finally cold rolled at a reduction rate of 60% to obtain finally cold rolled sheets having a final gauge of 0.30 mm. The finally cold rolled sheets were subjected to a decarburization annealing at 800° C. in wet hydrogen, applied with an annealing separator consisting mainly of MgO, subjected to a final annealing at 1,200° C. for 10 hours, and then applied with an insulating coating to produce grain-oriented silicon steel sheets. The magnetic properties of the products are shown in the following Table 8.

TABLE 8

| Sample steel No. | Slab (wt. %) Si | C | Decarburized amount ΔC | $W_{17/50}$ (W/kg) | $B_{10}$ (T) | Amount of fine grains (%) | Remarks |
|---|---|---|---|---|---|---|---|
| 29 | | | 0.003 | 1.15 | 1.88 | 30 | Comparative steel |
| 30 | 3.30 | 0.048 | 0.013 | 1.03 | 1.92 | 0 | Steel of this invention |
| 31 | | | 0.026 | 1.13 | 1.90 | 0 | Comparative steel |

It can be seen from Table 8, that, in sample steel No. 29, whose decarburized amount ΔC is 0.003%, which is less than the lower limit of the range defined in the present invention, the texture of the resulting steel sheet contains as large as 30% of fine grains, and satisfactory magnetic properties can not be obtained; while, in sample steel No. 31, whose decarburized amount ΔC is 0.026%, which is more than the upper limit of the defined range, the texture of the resulting steel sheet contains no fine grains but contains coarse secondary recrystallized grains, and the steel sheet has a satisfactorily high magnetic induction but has not a satisfactorily low iron loss value. On the contrary, in sample steel No. 30, which satisfies all the requirements defined in the present invention, the resulting steel sheet has concurrently a low iron loss value and a high magnetic induction. Therefore, according to the present invention, a satisfactory grain-oriented silicon steel sheet can be obtained.

EXAMPLE 7

Three slabs of 200 mm thickness having a composition containing 3.35% of Si, 0.050% of C, 0.05% of Mn, 0.03% of Se and 0.03% of Sb were produced by a continuous casting of a molten steel, heated at 1,380° C. for 1 hour, hot rolled into a thickness of 2.5 mm, and then coiled. The coiled sheets were pickled in a 10% $H_2SO_4$ bath kept at 80° C., subjected to a normalizing annealing at 980° C. for 30 seconds under a continuous annealing atmosphere of $P_{H2O}/P_{H2}=0.003$–$0.35$ by a commonly known method so as to remove 0.002%, 0.013% or 0.027% (decarburized amount ΔC) of carbon, cold rolled into a thickness of 0.75 mm, subjected to an intermediate annealing at 950° C. for 2 minutes, and then finally cold rolled at a reduction rate of 60% to obtain finally cold rolled sheets having a final gauge of 0.30 mm. The finally cold rolled sheets were subjected to a decarburization annealing at 800° C. in wet hydrogen, applied with an annealing separator consisting mainly of MgO, subjected to a final annealing at 1,200° C. for 10 hours, and then applied with an insulating coating to produce grain-oriented silicon steel sheets. The magnetic properties of the products are shown in the following Table 9.

TABLE 9

| Sample steel No. | Slab (wt. %) Si | C | Decarburized amount ΔC | $W_{17/50}$ (W/kg) | $B_{10}$ (T) | Amount of fine grains (%) | Remarks |
|---|---|---|---|---|---|---|---|
| 32 | | | 0.002 | 1.14 | 1.88 | 30 | Comparative steel |
| 33 | 3.35 | 0.050 | 0.013 | 1.02 | 1.93 | 0 | Steel of this invention |
| 34 | | | 0.027 | 1.12 | 1.89 | 0 | Comparative steel |

It can be seen from Table 9 that, in sample steel No. 32, whose decarburized amount ΔC is 0.002%, which is less than the lower limit of the range defined in the present invention, the texture of the resulting steel sheet contains as large as 30% of fine grains, and a steel sheet having a satisfactory low iron loss value and a high magnetic induction $B_{10}$ can not be obtained; while, in sample steel No. 34, whose decarburized amount ΔC is 0.027%, which is more than the upper limit of the defined range, the texture of the resulting steel sheet contains no fine grains but contains coarse secondary recrystallized grains, and the steel sheet has a satisfactorily high magnetic induction but has not a satisfactorily low iron loss. On the contrary, in sample steel No. 33, which satisfies all the requirements defined in the present invention, the resulting steel sheet has concurrently a low iron loss value and a high magnetic induction. Therefore, according to the present invention, a satisfactory grain-oriented silicon steel sheet can be obtained.

EXAMPLE 8

Three slabs of 200 mm thickness having a composition containing 3.3% of Si, 0.048% of C, 0.05% of Mn, 0.03% of Se and 0.03% of Sb were produced by a continuous casting of a molten steel, heated at 1,380° C. for 1 hour, hot rolled into a thickness of 2.5 mm, and then coiled. In sample steel No. 35, both a normalizing annealing at 980° C. for 30 seconds and an intermediate annealing at 950° C. for 2 minutes before the final cold rolling were carried out under a non-oxidizing atmosphere of $P_{H2O}/P_{H2}=0.003$ to remove 0.003% in total (total decarburized amount ΔC) of carbon. In sample steel No. 36, after the coiled sheet was pickled in a 10% $H_2SO_4$ bath kept at 80° C., both the normalizing annealing at 980° C. for 30 seconds and the intermediate annealing at 950° C. for 2 minutes were carried out under an atmosphere of $P_{H2O}/P_{H2}=0.05$ to remove 0.005% of C during the normalizing annealing and 0.008% of C during the intermediate annealing (total decarburized amount ΔC was 0.013%). In sample steel No. 37, after the coiled sheet was pickled in a 10% $H_2SO_4$ bath kept at 80° C., both the normalizing annealing at 980° C. for 30 seconds and the intermediate annealing at 950° C. for 2 minutes were carried out under an atmosphere of $P_{H2O}/P_{H2}=0.15$ to remove 0.012% of C during the normalizing annealing and 0.016% of C during the intermediate annealing (total decarburized amount ΔC was 0.028%).

After the above described normalizing annealing, the coiled sheets were cold rolled into a thickness of 0.75 mm, subjected to the above described intermediate annealing, and then finally cold rolled at a reduction rate of 60% to obtain finally cold rolled sheets having a final gauge of 0.30 mm. The finally cold rolled sheets were subjected to a decarburization annealing at 800° C. in wet hydrogen, applied with an annealing separator consisting mainly of MgO, subjected to a final annealing at 1,200° C. for 10 hours, and then applied with an insulating coating to produce grain-oriented silicon steel sheets. The magnetic properties of the products are shown in the following Table 10.

TABLE 10

| Sample steel No. | Slab (wt. %) Si | C | Decarburized amount ΔC | $W_{17/50}$ (W/kg) | $B_{10}$ (T) | Amount of fine grains (%) | Remarks |
|---|---|---|---|---|---|---|---|
| 35 | | | 0.003 | 1.12 | 1.89 | 25 | Comparative steel |
| 36 | 3.3 | 0.048 | 0.013 | 1.02 | 1.93 | 0 | Steel of this invention |
| 37 | | | 0.028 | 1.13 | 1.90 | 0 | Comparative steel |

It can be seen from Table 10 that the resulting steel sheet of sample steel No. 36 of the present invention has satisfactorily low iron loss value and high magnetic induction. In sample steel No. 35 whose decarburized amount is short, and in sample steel No. 37 whose decarburized amount is excess, aimed magnetic properties can not be obtained.

It can be seen from the above described examples that, when all the requirements defined in the present invention are satisfied, a grain-oriented silicon steel sheet having excellent magnetic properties, that is, having satisfactorily low iron loss value and high magnetic induction can be stably produced, and the present invention is very contributable for the production of transformer and other electric instruments having a low iron loss and a high efficiency.

There have hitherto been proposed various methods in the production of grain-oriented silicon steel sheets. However, in the conventional methods, during the high temperature heating of slab, particularly continuously cast slab, crystal grains are apt to be coarse, and the formation of so-called fine grain streak can not be stably prevented, and grain-oriented silicon steel sheets having excellent magnetic properties can not be stably produced in a commerical scale. On the contrary, according to the present invention, the composition of a slab to be used as a starting material is limited, and particularly the C content is properly adjusted depending upon the Si content, and at the same time the final cold rolling is carried out at a reduction rate of 40–80% to form a uniform crystal texture and to promote the predominant development of secondary recrystallized grains of (110)[001] orientation in the recrystallization texture, and further 0.006–0.020% of C is removed from the steel during the course after completion of the hot rolling and before the beginning of the final cold rolling, whereby silicon steel sheets having excellent magnetic properties can be stably produced.

What is claimed is:

1. In a method of producing grain-oriented silicon steel sheets having excellent magnetic properties, comprising a step of hot rolling a silicon steel having a composition containing, in % by weight, 2.8–4.0% of Si, 0.02–0.15% of Mn and 0.008–0.080% of a total amount of at least one of S and Se into a hot rolled steel sheet, a step of coiling the hot rolled steel sheet, a step of subjecting the coiled steel sheet to two or more cold rollings with an intermediate annealing between them, wherein the final cold rolling is carried out at a reduction rate of 40–80%, to produce a finally cold rolled steel sheet having a final gauge, and steps of subjecting the finally cold rolled steel sheet to a decarburization annealing and then to a final annealing, an improvement comprising said silicon steel having a C content, depending upon the Si content, within the range defined by the following formula $$0.37[Si\%]+0.27 \leqq \log([C\%]\times 10^3) \leqq 0.37[Si\%]+0.57$$

wherein [Si%] and [C%] represents contents (% by weight) of Si and C in the steel, respectively; and removing 0.006–0.020% by weight of C from the steel during the course after the completion of the above described hot rolling and just before the beginning of the above described final cold rolling.

2. A method according to claim 1, wherein 0.006–0.020% by weight of C is removed from the steel in a decarburization treatment carried out after the coiling and before the cold rolling.

3. A method according to claim 1, wherein 0.006–0.020% by weight of C is removed from the steel during the intermediate annealing carried out before the final cold rolling.

4. A method according to claim 1, wherein 0.006–0.020% by weight in total is removed from the steel in both the decarburization treatment, which is carried out after the coiling and before the cold rolling, and the intermediate annealing carried out before the final cold rolling.

5. A method according to claim 1, wherein the coiled steel sheet is additionally subjected to a normalizing annealing before the cold rolling, and 0.006–0.020% by weight of C is removed from the steel during the normalizing annealing.

6. A method according to claim 1, wherein the coiled steel sheet is additionally subjected to a box annealing and then to a normalizing annealing before the cold rolling, and 0.006–0.020% by weight of C is removed from the steel during the normalizing annealing.

7. A method according to claim 5, wherein 0.006–0.020% by weight of C in total is removed from the steel in at least one of the treatments of the decarburization treatment after the coiling, the normalizing annealing, and the intermediate annealing before the final cold rolling.

8. A method according to claim 6, wherein 0.006–0.020% by weight of C in total is removed from the steel in at least one of the treatments of the decarburization treatment after the coiling, the box annealing, the normalizing annealing, and the intermediate annealing before the final cold rolling.

* * * * *